United States Patent [19]

Gismervik et al.

[11] Patent Number: 4,499,348

[45] Date of Patent: Feb. 12, 1985

[54] MAGNETIC FLOAT CONTROLLED ELECTRIC SWITCH

[76] Inventors: Jan E. Gismervik, Knappenveien 62 A, N-5064 Straumsgrend; Gunnar Sveinsbo, Gravdalsveien 10, N-5034 Ytre Laksevåg, both of Norway

[21] Appl. No.: 395,063

[22] PCT Filed: Nov. 12, 1981

[86] PCT No.: PCT/NO81/00041

§ 371 Date: Jun. 22, 1982

§ 102(e) Date: Jun. 22, 1982

[87] PCT Pub. No.: WO82/01786

PCT Pub. Date: May 27, 1982

[30] Foreign Application Priority Data

Nov. 13, 1980 [NO] Norway ..... 803415

[51] Int. Cl.[3] ..... H01H 35/18

[52] U.S. Cl. ..... 200/84 C; 335/207

[58] Field of Search ..... 307/118; 200/84 C; 340/623-625; 73/308, 313; 335/207, 205

[56] References Cited

U.S. PATENT DOCUMENTS

| | | | |
|---|---|---|---|
| 3,149,753 | 9/1964 | Forsyth | 200/84 C X |
| 3,823,328 | 7/1974 | Barton et al. | 307/118 |
| 4,165,935 | 8/1979 | Bongort et al. | 335/207 |
| 4,258,238 | 3/1981 | Dombrowski et al. | 200/84 C |

FOREIGN PATENT DOCUMENTS 2254016 10/1976 France .

*Primary Examiner*—J. R. Scott

*Attorney, Agent, or Firm*—Ladas & Parry

[57] ABSTRACT

Float-controlled electrical switch (11) includes a reed contact (22) which is opened and closed by the field of force of a permanent magnet (32). The permanent magnet is embedded in a float which can be moved by rising and falling liquid levels towards and away from the reed contact for closing and opening of the reed contact. The reed contact (22) cooperates with a relay (25) which provides for engaging and disengaging of a working contact (18) for engagement and disengagement of a bilge pump (10) or another power device in connection with inspection of two separate liquid levels. Provision is made for a large distance between the liquid levels together with markedly distinct positions for engagement and disengagement of the reed contact by allowing the electromagnetic field of force of the coil (24) of the relay (25) to cooperate with the field of force of the permanent magnet. Provision is made in this connection that the field of force of the coil be less than the field of force of the permanent magnet and that the field of force of the coil alone is too weak to maintain the reed contact engaged. Simple components are employed made of rectangular pipe of plastic for constructing the housing part (30) of the switch, the float (31) together with the insert part (35) for installation and possible withdrawal of float from housing part.

5 Claims, 5 Drawing Figures

MAGNETIC FLOAT CONTROLLED ELECTRIC SWITCH

This invention relates to electrical switch devices and, more particularly, to float-controlled electrical switch devices.

DESCRIPTION OF THE PRIOR ART

A conventional reed magnet switch is shown in U.S. Pat. No. 2,823,328.

The present invention finds particular application in the control of the liquid level in the bottom of a boat, such as a sail boat or motor boat. The switch according to the invention shall in the case of application control the engagement and disengagement of a bilge pump for removing liquid which has collected in the bottom of the boat, gradually as there is a need for it, that is to say in an automatically controlled manner determined by a fixed upper and lower level of liquid in the bottom of the boat. Stated in another way the switch provides for the bilge pump to be engaged when the liquid level has risen sufficiently high in the boat and for the bilge pump to remain engaged until the liquid level in the boat has sunk again to the determined lower level in the boat. It is the permanent magnet which engages and disengages the switch, the permanent magnet being controlled towards and away from the reed contact of the switch by means of a buoyancy force in a float which follows the movements of the liquid between upper and lower liquid levels.

The invention is, however, not limited to application for bilge pumps, but can also be used for various other types of electrically driven power means which will function in connection with a controlled liquid level, for example the liquid level in a tank, in a flow passage or for similar purposes. In the following description the invention will be described having regard to its application in connection with a bilge pump in a boat.

In U.S. Pat. No. 4,165,935 there is disclosed a level switch which operates according to the reed principle but where two magnets are employed, the one for opening the reed contact and the other for closing the reed contact. In this case there is a level switch where the regulating distance is limited by the length of the reed contact. Furthermore, the level switch is particularly critical as regards the level for engagement and the level for disengagement, since the two magnets must be adapted to each other, and this adaptation must be adjusted in every single case. In addition, there is the possibility for different age weakening of the two magnets, something which in turn will be able to disturb the desired effect.

In the use of a reed contact and an associated moveable permanent magnet there can be obtained under normal working conditions a particular level for engaging the bilge pump and a corresponding particular level for disengaging the bilge pump, fixed by an upper and a lower liquid level with a distance of, for example, 5 mm between the liquid levels. By increasing or reducing the strength of the permanent magnet the distance between the liquid levels can be increased or diminished to a certain degree, but at the same time the distance between the reed contact and permanent magnet will also be increased or reduced in the engagement position (upper liquid level). This can be compensated for to a certain degree by increasing or reducing the A/turn number for the reed contact. In all cases, however, it is difficult to attain a desired significant distance between the upper and lower liquid level, that is to say the engagement and disengagement positions of the permanent magnetic field of force of the float.

FIELD OF THE INVENTION

In certain instances, for example as a consequence of the movements of the boat during heavy seas and from this ensuing rolling or pitching movements of the boat and corresponding splashing movements of the collection of liquid in the bottom of the boat, the above-mentioned distance between upper and lower liquid levels is too small so that in practice a pulsating engagement and disengagement of the bilge pump can result produced by the movements of the boat.

As a result of the relatively moderate distance between the upper and lower liquid levels in the bottom of the boat the bilge pump also has the tendency to expel relatively moderate amounts of liquid in each pumping operation, and often there is the question, therefore, of a relatively frequent engagement and disengagement of the bilge pump with relatively poor efficiency of the pump and with a large loading on the pump and switch components, under otherwise favorable operative conditions with moderate movements of the boat.

With the present invention the aim is to achieve a substantially greater distance between upper and lower liquid levels, without thereby altering the permanent magnet and its field of force, but nevertheless so that a less frequent engagement and disengagement of the bilge pump is obtained together with longer intervals with the bilge pump engaged. At the same time the aim is to obtain a more pronounced division between the level for engaging and disengaging the reed contact.

SUMMARY OF THE INVENTION

According to the present invention an electrical switch device comprises (a) a permanent magnet, (b) a reed contact openable and closeable by means of the field of force of said magnet, the axial direction of the reed contact extending parallel to the N-S direction of said magnet, (c) outer actuating force means for moving said magnet towards and away from the reed contact in an accurately controlled, rectilinear path of movement, and (d) a relay disposed relatively tightly up to said reed contact and coupled in series therewith, said relay having a coil with an electromagnetic field of force weaker than the field of force of said magnet and too weak to alone keep the reed contact engaged.

By the solution according to the invention engagement is obtained at an upper level in a known manner quite independently of the field of force of the permanent magnet. However, when the reed contact is first engaged it is ensured that this is kept engaged since at the same time an extra field of force is established over the reed contact produced by the electromagnetic field of force in the coil of the relay. This extra field of force will cooperate with the field of force of the permanent magnet so long as the reed contact is engaged and thereby as long as the bilge pump is in operation. By the solution according to the invention one thus arrives as a consequence of the combined action of the field of force of the coil and the permanent magnet at being able to move the float with associated permanent magnet a significantly larger distance below the upper liquid level before the lower liquid level is reached where the reed contact opens and thereby breaks the current to the relay with associated coil and simultaneously breaks the current to the bilge pump. Also according to the invention a fixed level for disengaging the reed contact is arrived at, and a main advantage according to the invention is that the fixed level for disengaging the reed contact is markedly separate from the level for engaging the reed contact.

On newly engaging the reed contact after the permanent magnet in the float has risen again to the upper liquid level one is only dependent upon the field of force of the permanent magnet for engagement of the reed contact, the field of force of the coil at this stage not yet being engaged. Consequently, according to the invention there are ensured markedly separate engagement and disengagement levels with a relatively large distance between the levels, and thereby one has ensured against unintentional, accidental engagements and disengagements of the bilge pump, and at the same time there is guaranteed relatively longer operation times of the bilge pump each time it is engaged.

According to the invention there is attained an especially accurate engagement and disengagement by allowing the axial direction of the reed contact to extend at right angles across the axial direction of the coil of the relay.

In a particularly preferred, practical construction of the switch according to the invention this is characterised in that its electrical components, which in a manner known per se are embedded in an electrically insulating plastic material in the housing part of the switch are arranged in an upper sleeve-shaped portion of the housing part, and that the lower portion of the housing part forms a guide chamber for a float which forms a support for the permanent magnet, the lower portion of the housing part being provided above with an air passage and below with a passage for liquid. In this way there is obtained a constructional solution which involves a ready manufacture of the various components and parts of the switch and a simple mounting of these components and parts.

It is preferred that the housing part is made of rectangular plastic pipe (preferably PVC pipe) and its lower portion includes a float of rectangular cross-section which prevents angular displacement of the float relative to the housing part.

Especially with easy mounting in view, but also with the thought of ready dismantling with inspection and cleaning of the float and its guide chamber it is preferred that the float is received in a drawer-like insert member made of a pipe fragment of rectangular cross-section, two opposing side walls of the insert member forming an upper and lower limit of the guide chamber of the float.

BRIEF DESCRIPTION OF THE DRAWINGS

In order that the invention can be more clearly understood, a convenient embodiment thereof will now be described, by way of example, with reference to the accompanying drawings in which.

DESCRIPTION OF THE PREFERRED EMBODIMENT

Figure 1:
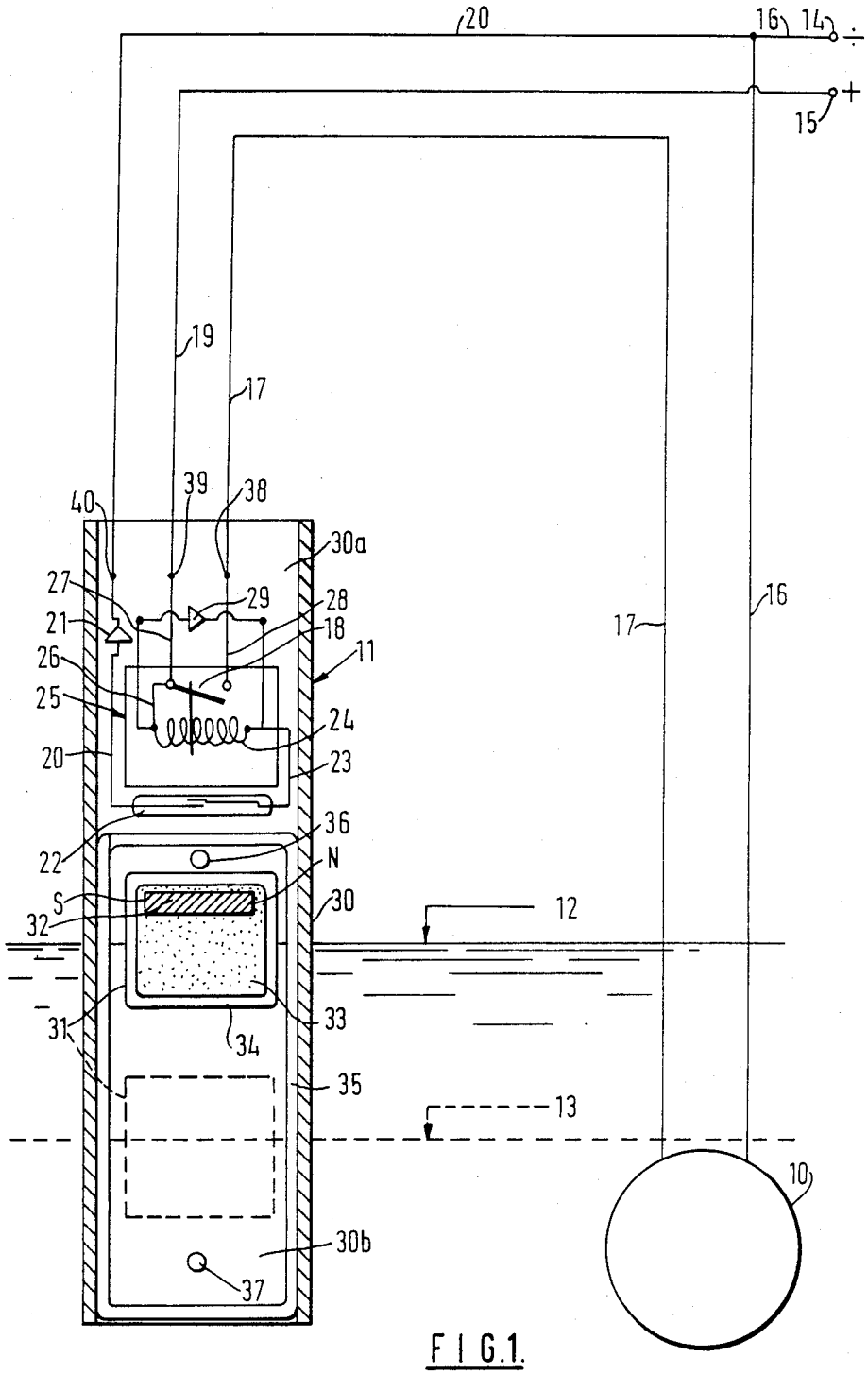
FIG. 1 is an electrical coupling diagram of a switch device used in connection with a bilge pump which is submerged in a liquid at the bottom of a boat.

Referring to FIG. 1, direct current-driven bilge pump 10 and float-controlled switch device 11 for controlling two liquid levels, namely an upper liquid level 12 shown in a full line and a lower liquid level 13 shown in a broken line, are shown electrically coupled together. The two liquid levels 12, 13 are the actual liquid levels in the bottom of a boat. The upper level 12 indicates the level for starting of the bilge pump 10 while the lower level 13 indicates the level for stopping the bilge pump. The bilge pump is submerged below the lower level and in all cases provision is made for the intake of the bilge pump to be submerged below the lower level 13.

From a source of direct current, for example, a 12 volt battery (not shown), as illustrated by positive and negative terminals 15, 14, there extends a first lead 16 from the negative terminal 14 to one side of the bilge pump 10, and from the other side of the bilge pump there extends a second lead 17 to the one side of a working contact 18, while from the other side of the working contact 18 a third lead 19 extends to the positive terminal 15. The leads 16, 17, 19 form a working circuit from the battery to the bilge pump via the float-controlled switch 11.

From the lead 16 there extends a branch lead 20 via a first diode 21 of 100 mA to the one side of a reed contact 22 having 25–30 A/turn. From the opposite side of the reed contact or reed contact switch 22 there extends a lead 23 to the one side of a coil 24 in a relay 25 which includes the working contact 18. The coil 24 is dimensioned for an electrical current of 100–110 mA. From the opposite side of the coil 24 there extends a lead 26 to the lead 19. Between two terminals 27, 28 which are each connected to a respective side of the coil 24 there is inserted a second diode 29 of 100 mA parallel to the coil 24. The leads 20, 23, 26 with associated reed contact 22 and coil 24 form a control circuit for the relay 25 which controls the working contact 18. By means of the diode 21 sparking in the reed contact 22 is counteracted by opening of the latter, and by means of the diode 29 faulty coupling of the leads 16 and 19 to the positive and negative terminals of the battery is prevented.

From FIG. 1 it is evident that the electrical components of the switch (the reed contact 22, the relay 25 and the diodes 21, 29) are received in the upper portion **30*a* of a sleeve-shaped housing member 30 made of rectangular PVC pipe, while the lower portion 30*b* of the housing member forms a guide for a float 31 which has a corresponding rectangular cross-section and which includes a permanent magnet 32 embedded in a foamed plastic material 33. Outermost the foamed plastic material is surrounded on four sides by a casing 34 of a rectangular PVC pipe fragment and on the two outer sides it is covered by an epoxy based hardening plastic (STYCAST 2651 and catalyst 9) supplied by Emerson & Cunning, Inc., Belgium. The lower portion 30*b* of the housing part 30 is defined by a drawer-like insert part 35 in the form of a rectangular PVC pipe fragment. The pipe fragment 35 is placed on edge so that two of its opposing sides form upper and lower boundary surfaces of the float 31**.

In FIG. 1 the float 31 is shown in full lines in an upper position, and the float is shown in broken lines in a lower position in the lower portion of the housing part 30. There is illustrated an upper air passage 36 in the wall of the housing part 30 just above the float 31 in its upper position and a lower passage 37 for liquid in the wall of the housing part 30 just below the float 31 in its lower position. Provision is made for the passage 37 for liquid to open out into the guide in the housing part 30 at a level significantly below the lower liquid level 13 in order to counteract the penetration of any oil which floats on top of the liquid in the bottom of the boat. The passage 37 for liquid is dimensioned so that there is little influence on the liquid level in the housing part due to wave movements or splash movements in the liquid outside the housing part 30.

Provision is made for the N-S direction of the permanent magnet 32 to extend parallel to the axial direction of the reed contact 22 and with its N-pole turned towards the positive side of the reed contact 22 and its S-pole turned towards the negative side of the reed contact 22. In this connection it is of importance that the float 31 and the guide internally in the housing part 30 together with the insert part 35 are designed with corresponding rectangular cross-sections so that unintentional turning of the float in the housing part 30 is avoided. The insert part 35 is pushed (together with the float 31) into the housing part 30, as is indicated in FIGS. 1 and 2, with a relatively narrow fit, while the float 31, as is indicated in FIGS. 1 and 2, is received with a relatively abundant fit in the housing part 30 and the insert part 35.

In the drawing in FIG. 1 the axial direction of the coil 24 is shown for the sake of simplicity parallel to the axial direction of the reed contact 22, but in practice provision is made for the axial direction of the coil to extend at right angles across the axial direction of the reed contact so that the force field lines coincide with the force lines of the permanent magnet.

Figure 2:
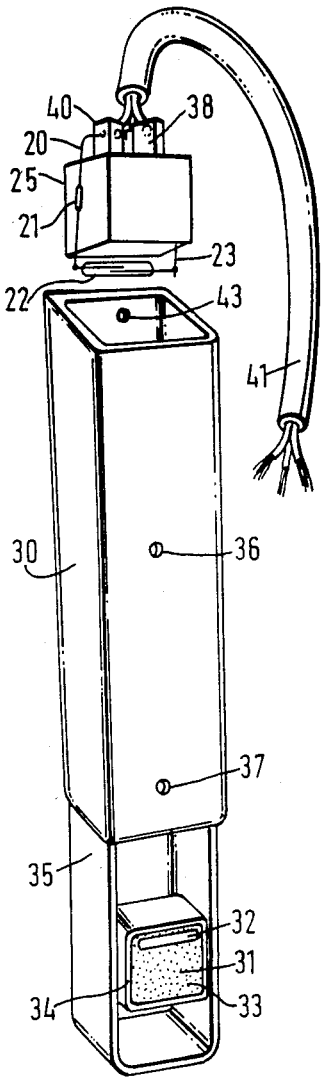
FIG. 2 is a perspective view of the switch device of FIG. 1 showing different parts of the device drawn axially outwards relative to each other in order to illustrate the simple construction and the simple mounting of the parts of the switch device.

On mounting the electrical components of the switch in the housing part 30 there is employed a relay 25 built into a housing part 25*a* and the latter is fastened via coupling clamps 38, 39, 40 to a three lead cable 41 (including the leads 17, 19, 20) having an outer PVC casing, as is shown in FIG. 2. The diodes 21 and 29 and the reed contact 22 together with the associated leads are fastened into position outside the housing of the relay 25, as is shown in FIG. 2.

After the insert part 35 with the float 31 is pushed into position in the lower portion of the housing part 30, provision is made first for a sealing between the insert part 35 and the housing part 30, for example, by means of a silicone coating. Afterwards the upper portion of the housing part 30 is filled with a suitable amount of the said two component epoxy-based hardening plastic (STYCAST 2651 and catalyst 9), after which the relay 25 with associated lead connections, reed contact and diodes are submerged in the hardening plastic. Provision is made for the hardening plastic to be filled to a suitable level upwardly on the PVC casing of the cable 41. By means of the hardened hardening plastic 42 there is achieved an effective mechanical connection between the casing of the cable 41 and the housing part 30 (together with the insert part 35) at the same time as the electrical components and associated connections are received in a protective manner in the housing part, embedded in an electrically insulating, flame-proof material.

Instead of the illustrated mechanical connection which is established between the hardening plastic and the insert part 35 the insert part can be axially displaceably received in the housing part 30 so that the insert part with associated float 31 can be taken out for cleaning and possible replacement of the float, where this seems desirable. In the last-mentioned instance the insert part 35 can, for example, be fastened in the housing part by a friction fit or can be fastened to the housing part with a transverse screw or with other suitable fastening means.

Figure 3:
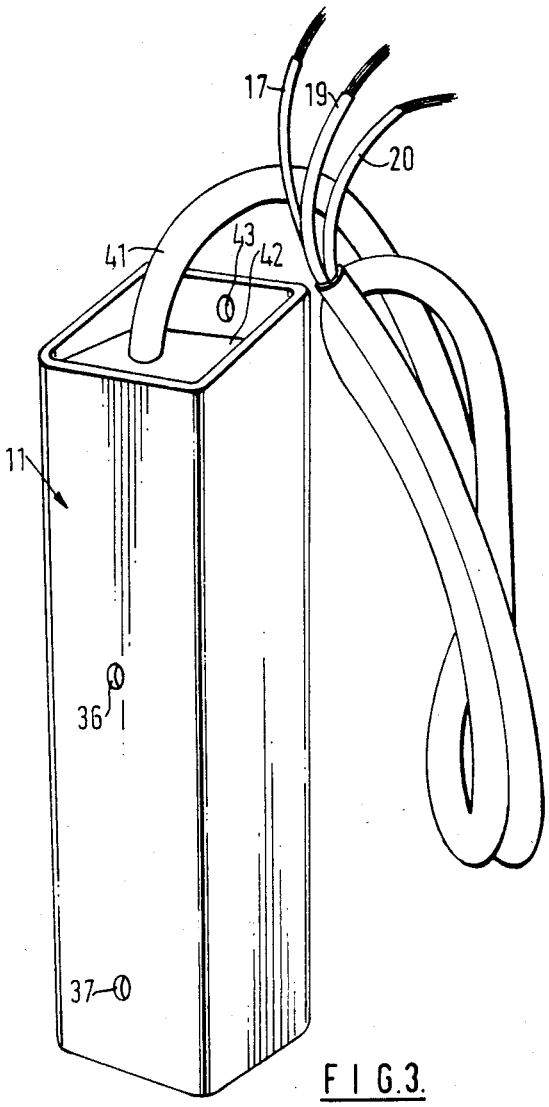
FIG.3 is another perspective view of the switch device of FIG. 1 showing the device ready for coupling together with the bilge pump or another power means and the associated direct current.
Figure 4:
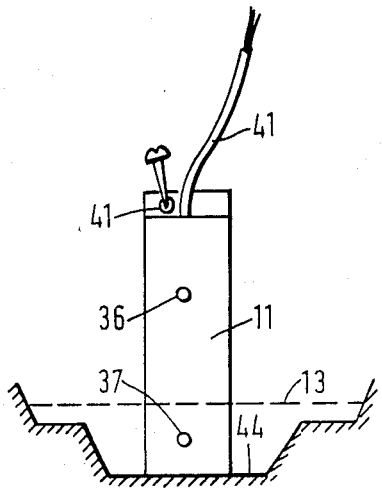
FIGS. 4 and 5 are sketches illustrating two different modes of mounting of the switch device of FIG. 1.
Figure 5:
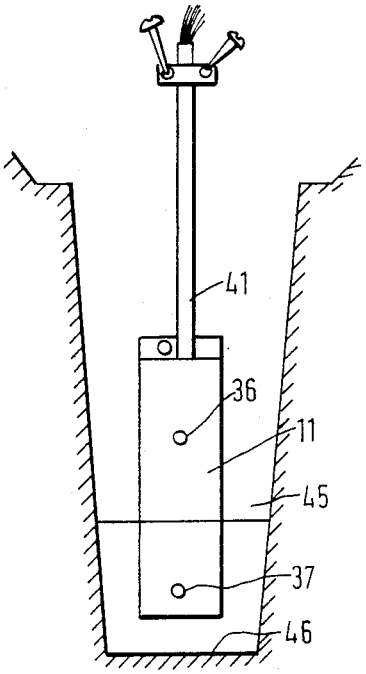

In FIG. 3 the switch 11 is shown in a finally made condition with associated cable 41 ready for mounting. A screw fastening hole 43 is shown at the upper end of the switch for securing the switch to a suitable fastening in the bottom of a boat, as is indicated in FIG. 4, so that the switch is stationarily secured in a keel countersinking 44 at the bottom. Alternatively, the switch can be suspended freely hanging over the bottom 46 of a keel countersinking 45 via the cable 41 of the switch, as is shown in FIG. 5. The last-mentioned can be particularly relevant in a case where the keel countersinking is relatively deep and problems can be presented in fixing the switch to a suitable fastening at a sufficiently low level in the keel countersinking.

We claim:

1. An electrical switch device which comprises,
a permanent magnet having a field of force,
float means supporting the permanent magnet,
a reed contact switch having a longitudinal axis, openable and closeable by the field of force of said permanent magnet, and being positioned with it's longitudinal axis extending substantially parallel to the North-South direction of said magnet,
outer actuating means moving said magnet towards and away from said reed contact switch in an accurately controlled rectilinear path of movement wherein the outer actuating means is the buoyancy of said float means and a relay disposed near said reed contact switch and coupled in series therewith, said relay having a coil with an electromagnetic field of force weaker than the field of force of said magnet and which is too weak to alone keep the reed contact switch engaged but which provides an additional field of force in keeping said reed contact switch engaged so that said magnet can be moved a predetermined distance by said actuating means.

2. The device as claimed in claim 1, wherein the axial direction of the reed contact extends at right angles across the axial direction of the coil of the relay.

3. The device as claimed in claim 1, which comprises a housing for its electrical components which are embedded in an electrically insulating material in said housing, an upper sleeve portion of said housing having said electrical components arranged therein and a lower portion of said housing forming a guide chamber for said float means and being provided above with an air passage and below with a passage for liquid.

4. The device as claimed in claim 3, wherein the housing is composed of rectangular pipe made of a synthetic plastics material and said float means is of rectangular cross-section to prevent its angular displacement relative to the lower portion of said housing.

5. The device as claimed in claim 3, wherein the lower portion of said housing has a drawer-like insert formed from piping of rectangular cross-section, two opposing sides of said insert forming upper and lower limits of the guide chamber for the float means.

* * * * *